United States Patent [19]

Gerry

[11] 4,398,125

[45] Aug. 9, 1983

[54] FORCE FIELD ANTI-NOISE-INDUCTION SYSTEM

[76] Inventor: Martin E. Gerry, 13452 Winthrope St., Santa Ana, Calif. 92705

[21] Appl. No.: 316,542

[22] Filed: Oct. 29, 1981

[51] Int. Cl.[3] ..... H05B 37/00; H05B 41/14

[52] U.S. Cl. ..... 315/86; 174/73 R; 174/127; 174/140 CR; 339/143 C

[58] Field of Search ..... 174/32, 35 R, 35 C, 174/35 SM, 36, 73, 102 R, 127, 140 CR, 144; 307/91; 315/86; 339/143 C, 143 R

[56] References Cited

U.S. PATENT DOCUMENTS 3,433,687 3/1969 Price ..... 174/127

4,347,487 8/1981 Martin ..... 174/36

*Primary Examiner*—Alfred E. Smith

*Assistant Examiner*—Robert E. Wise

[57] ABSTRACT

An electrical ignition system for a fuel buring engine has a high voltage ignition cable (60) that includes an electrically conductive shield (64) circumjacent an electrical axial conductor (62). An AC or DC power source **(70, 70*a*, 70*b*) is connected to the electrically conductive shield to produce an electromagnetic force field surrounding the electrical axial conductor. Such field retains electromagnetic radiation emanated by the electrical axial conductor during ignition of the igniter (10) within the confines of the shield (64). Igniter (10) may have a ceramic insulator (30) with a synthetic resin polymer sleeve (50) covering a portion of the ceramic insulator, or insulator (30) may be made entirely of the synthetic resin polymer material to suppress corona generated by current flowing through the axial electrode (40)** of the igniter during each ignition period.

11 Claims, 3 Drawing Figures

FORCE FIELD ANTI-NOISE-INDUCTION SYSTEM

DESCRIPTION

Technical Field

This invention is in the field of methods for preventing transfer of radio noise to an automotive receiver created by induction of transient current of the automotive ignition system.

Background Art

Reduction of radio noise is accomplished by utilizing a high resistance axial conductor in each high voltage ignition cable, often accompanied by utilizing an igniter having a built-in resistor. Commonly, the average length high voltage ignition cable has a resistance in the order of 15,000 ohms and the igniter resistor a resistance in the order of 5000 ohms. Utilizing either such high resistance cable and/or resistive igniter dramatically reduces ignition current. Such reduction is ignition current prevents a large fuel nodule volume to be ignited upon igniter firing and results in reduction in engine operative efficiency and increased fuel consumption.

DISCLOSURE OF INVENTION

Therefore it is an objective of this invention to eliminate the use of high resistive ignition cables and/or high resistive igniters, substituting highly conductive ignition cables and igniters, so as to increase the ignition current and cause a large fuel nodule volume to be initiated upon igniter firing.

It is also an objective of this invention to generate a long electrical arc at the base of each igniter to further increase the volume of the initial fuel nodule.

It is yet another objective of this invention to create increased ignition currents and such long arcs by creating force fields of electromagnetic character to surround the high voltage ignition cables and thereby prevent ignition currents from being coupled by induction to the automotive receiver.

It is still another objective of this invention to utilize high ignition currents and voltages and at the same time suppress or avoid the creation of corona rings surrounding the electrical insulator of the igniters when high currents are passed through the axial electrodes of such igniters upon ignition of such igniters.

Accordingly, an electrical ignition system for a fuel burning engine is provided with at least one high voltage ignition cable having an axial conductor connected to an igniter. Electrical conductive means, circumjacent to and integral with such cable and electrically insulated from the axial conductor, enables an electrical current to be passed through the electrical conductive means. Electrical power means, connected to the electrical conductive means, produces a force field surrounding the electrical axial conductor, such force field confining an electromagnetic field produced due to current flowing through the axial electrode of the igniter. The electrical conductive means may be powered by alternating or direct current sources.

The electrical igniter has an electrically insulative member that retains the axial electrode. Such insulative member may be made of a synthetic resin polymer such as polytetrafluoroethylene (trade name Teflon) or may be a ceramic material with a polytetrafluoroethylene sleeve circumjacent the ceramic insulative material to suppress corona rings generated by high currents flowing through the axial electrode during igniter ignition.

DETAILED DESCRIPTION OF BEST MODE FOR CARRYING OUT THE INVENTION

Figure 1:
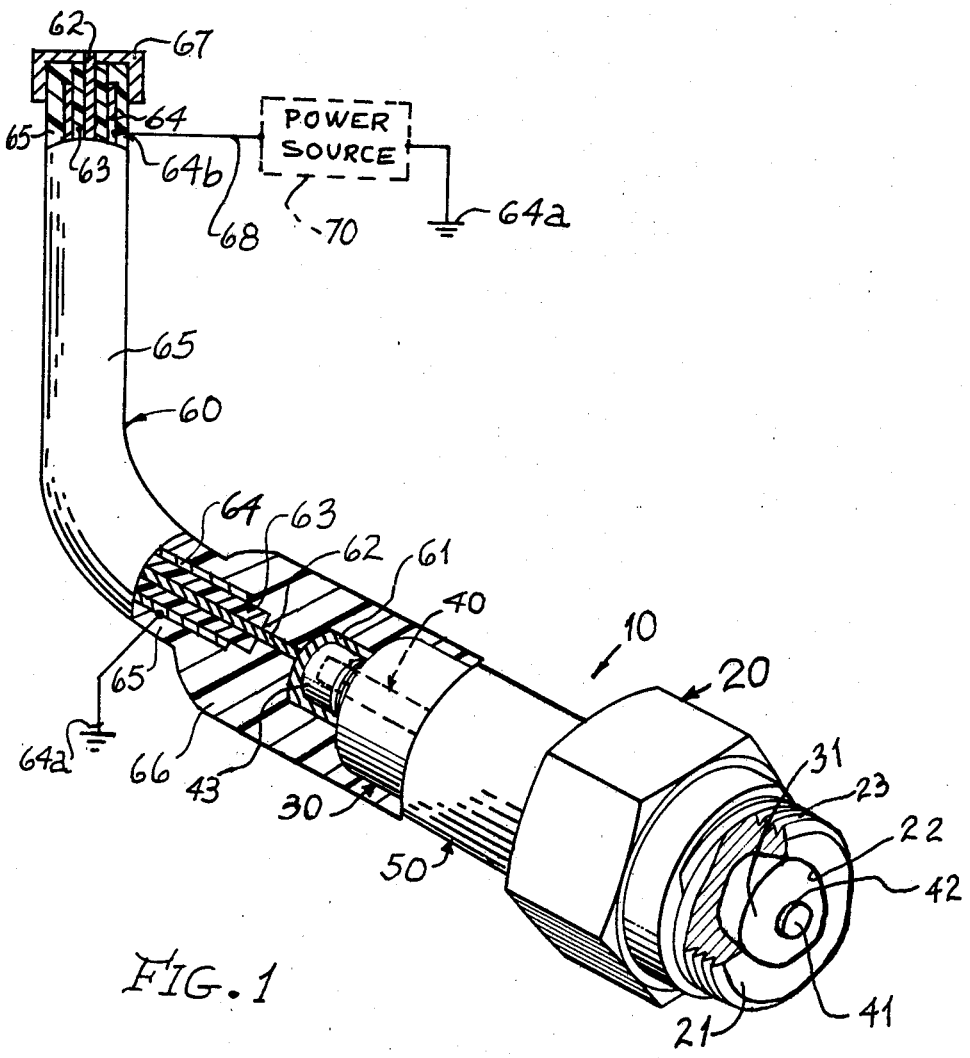
FIG. 1 is a perspective view partially in cross section of an igniter connected to a high voltage ignition cable in accordance with this invention.

Referring to FIG. 1, an igniter 10, according to this invention is connected to a high voltage ignition cable 60, also according to this invention.

Igniter 10 has a metallic base 20, and base 20 terminates at the igniter's firing end at 21. The inner periphery 22 of base 20 is coterminous at the igniter's firing end at 21 with portion 31 of electrical insulator 30. Base 20 also has a threaded portion 23 that is used to fit the igniter into a combustion chamber of a fuel burning engine. Insulator 30 retains axial electrode 40 extending lengthwise through the igniter and terminating at 41 at the firing end of the igniter and substantially coterminous with the firing end 21 of base 20 and portion 31 of insulator 30. On igniter firing, an ignition arc between an exposed side 42 of axial electrode 40 and the inner periphery 22 of base 20 will occur following the contour of the firing end 31 of insulator 30. The end of axial electrode 40 that is opposite firing end 41 has a metallic cap 43 thereon for fitting a connector 61 of cable 60 thereto. Insulator 30, if made of the conventional ceramic material, may have a sleeve 50 circumjacent thereto between base 20 and insulating sleeve 66 of cable 60. Sleeve 50 is made of a synthetic resin polymer such as polytetrafluoroethylene (trade name Teflon) and is utilized to suppress a corona ring encircling insulator 30 when large electrical currents flow through axial electrode 40 during igniter firing. If insulator 30 were made of a high temperature synthetic resin polymer material, then sleeve 50 would not be necessary as that type of material is known to suppress corona or prevent corona rings from forming. Corona rings are formed during igniter high current flow when the distance between insulator 30 and the engine metallic structure is spaced less than two insulator 30 diameters. Consequently, a well designed engine head having large spacing between insulator 30 and the engine's metallic structure will preclude the formation of corona rings about and around insulator 30.

Cable 60 is fitted to igniter 10 by virtue of slipping electrically insulating sleeve 66 over insulator 30 so that the end of sleeve 66 abuts or cooperates with sleeve 50 when same is used, thereby causing electrical connector 61 embedded in sleeve 66 to fit over and make electrical connection with cap 43 of axial electrode 40.

The structure of cable 60 comprises an axial conductor 62 of high electrical conductivity such as copper material to permit virtually all the current generated by the automotive ignition system to be fed to axial electrode 40 of igniter 10. Axial electrode 40 may also be made of highly electrical conductive material hardened at end 41 to withstand high engine temperatures. Such electrode 40 being of relatively short length can be made of steel and will exhibit a resistance of less than one ohm.

Axial conductor 62 has an electrical insulating tubing 63 thereover preferably of a synthetic resin polymer such as polytetrafluoroethylene so as to suppress corona formation.

A shield of electrically conductive material 64 is formed over tubing 63. Shield 64 may be either of a braided flexible copper material or may constitute a spirally wound wire, such as magnet wire having an electrical insulating coating, wound about tubing 63 along the length of such tubing. Shield 64 is electrically connected to electrical return 64*a* at one end, symbolized by a conventional ground symbol, and at the other end is electrically connected at 64*b* to an electrical wire 68 which is fed by electrical power source 70. Power source 70 is also connected to ground return 64*a*.

The outer electrical insulation 65 of cable 60 may be made of a synthetic resin polymer or other suitable electrical insulation similar to that used for sleeve 66, and insulation 65 is integral with sleeve 66 insulation.

The end of axial conductor 62, opposite to its other end terminating at cap 61, is electrically connected to cap 67, which cap 67 is fitted to and makes electrical connection with a conventional automotive distributor entry port when more than one igniter is used or directly to the high voltage exit port of the automotive ignition transformer when only one igniter is used; neither the distributor nor the ignition transformer being illustrated herein since both are well known in the ignition art.

It should be noted that connecting power source 70 to shield 64 produces an electrical current flow through shield 64 and consequently a tubular-shaped electromagnetic field, being herein defined as a force field, surrounding axial electrode 62 to confine electromagnetic radiation within shield 64, which electromagnetic radiation is caused by a transient current flowing in axial electrode 40 and axial conductor 62 during ignition state of ignitor 10, which ignition state causes an electrical arc to form between locations 22 and 42 of ignitor 10.

Analogy may be drawn between signal and noise in conventional electromagnetic radiation systems and noise suppression in the instant system. The ignition transient current being of irregular shape may be considered as the noise, and the current flowing through shield 64 initiated by power source 70 may be considered as the signal. The signal current fed via wire 68 is substantially larger than the noise current flowing in conductor 62, and hence the electromagnetic field created by the signal current is substantially larger than the electromagnetic field created by the noise current. Accordingly, the induction of the noise field will be swamped by the induction of the signal field, effectively confining the noise field to the inside of tubular shield 64 and inhibiting noise field induction into the antenna of the automotive receiver. Another way of stating this phenomena is that the electromagnetic field due to igniter current is confined by the electromagnetic field radiated by shield 64 maintaining the field due to ignition current substantially within the confines of shield 64.

Figure 2:
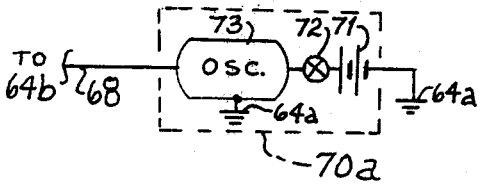
FIG. 2 is an electrical schematic showing an oscillator connected to shielding means circumjacent the axial electrical conductor of the cable.
Figure 3:
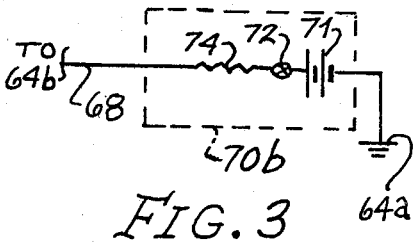
FIG. 3 is an electrical schematic showing a direct current source connected to the shielding means circumjacent the axial electrical conductor of the cable.

Referring to FIGS. 1, 2 and 3, it should be understood that power source 70 was a general presentation for either power sources 70*a* or 70*b*. Accordingly, when power source 70*a* is utilized, automotive battery 71 provides DC power through ignition switch 72 to oscillator 73, and oscillator 73 feeds AC power to shield 64 via wire 68. Thus the current flowing in shield 64 will be of the alternating type and an alternating electromagnetic field will be produced encircling axial conductor 62. The AC power generated may be sinusoidal or may be generally retangular in shape at fundamental frequencies of about 500 KHz. The rectangular waveform will produce an array of harmonic electromagnetic sub-fields covering the entire broadcast band and frequency modulation band to prevent noise transfer by induction into the automotive receiver. Power source 70*b*, on the other hand, produces a DC field surrounding axial conductor 62 and inhibits electromagnetic noise induction from axial conductor 62 into the automotive receiver. DC power to feed wire 68 and hence shield 64 is produced by virtue of battery 71 feeding DC power via ignition switch 72 through resistor 74 to shield 64. Resistor 74 is used to avoid an electrical short circuit across battery 71, the resistance value of resistor 74 being determined by the quantity of current necessary to flow in shield 64 to establish a strong DC field surrounding axial conductor 62. A 10 ohm resistance value for resistor 64 will produce about a one-ampere DC current to provide a very strong DC field.

It should be noted that whether power source 70*a* or power source 70*b* is used, that shield 64 may be either a braided metal type or the spirally wound wire about and along the length of axial conductor 62.

With respect to the structure of igniter 10, and in view of the long arcs created between locations 22 and 42, insulator portion 31 extending in coterminous relationship with end 21 of base 20, prevents fouling of the igniter due to oxide accumulation at the igniter base.

Of particular importance in reducing the resistance path for ignition current by utilization of igniters 10 and cables 60, is due to the fact that the recently developed systems by the same inventive entity producing over 50 kilowatts of instantaneous peak power that enables efficient fuel combustion. Such high power systems require the low attenuating cables 60 and igniters 10 to be effective, in addition to the noise transfer inhibition accomplished by such cable systems.

With respect to utilization of power source 70*a*, it should be noted that passing an alternating current through shield 64 will have no effect on intermodulation with the transient current flowing through axial conductor 62. To obtain intermodulation of the two currents it would be necessary for these currents or the fields produced thereby to be passed through a common non-linear device such as a square law detector or an inductor, and consequently the current through shield 64 will be effective to produce a field that confines the field produced by the transient current flowing in axial conductor 62.

With respect to utilization of power source 70*b*, no modulation is possible between the field produced due to transient current in axial conductor 62 and the field produced due to current flow in shield 64 for similar reasons as above stated and also because the field due to current flow in shield 64 is a DC field, to also confine the transient field within the tubular-shaped structure of shield 64.

I claim:

1. An electrical ignition system for a fuel burning engine, said system having at least one high voltage ignition cable with an axial conductor connected to an axial electrode of an igniter, the improvement comprising the combination of:

electrical conductive means, circumjacent to and integral with said cable and electrically insulated from said axial conductor, for enabling an electrical current to be passed therethrough; and electrical power means, connected to said electrical conductive means, for producing a force field surrounding said axial conductor, said force field confining an electromagnetic field produced during firing of said igniter.

2. The system as stated in claim 1, wherein said electrical power means is an electrical oscillator.

3. The system as stated in claim 1, wherein said electrical power means is a direct current source in series with a resistor.

4. The system as stated in claim 1, wherein said electrical conductive means constitutes a tubular metallic shield.

5. The system as stated in claim 1, wherein said electrical conductive means constitutes an electrical conductor electrically insulated from and spirally wound around said axial conductor.

6. The system as stated in claim 1, including insulative means, circumjacent to and retaining said axial electrode, for inhibiting the generation of corona in proximity of said igniter.

7. The system as stated in claim 1, wherein said igniter has an electrical insulator surrounding and retaining said axial electrode and a metallic base retaining said insulator, one end of said base and one end of said insulator being substantially coterminous.

8. The system as stated in claim 6, wherein said insulative means constitutes a synthetic resin polymer.

9. The system as stated in claim 6, wherein said insulative means is made of polytetrafluoroethylene.

10. The system as stated in claim 6, wherein said insulative means comprises a ceramic insulator and a synthetic resin polymer sleeve circumjacent to and in cooperation with a portion of the ceramic insulator.

11. The system as stated in claim 6, wherein said insulative means comprises a ceramic insulator and a polytetrafluoroethylene sleeve circumjacent to and in cooperation with a portion of the ceramic insulator.

* * * * *